US010519698B2

(12) United States Patent
Maple

(10) Patent No.: US 10,519,698 B2
(45) Date of Patent: Dec. 31, 2019

(54) ELECTRICALLY CONTROLLED LOCKING ARRANGEMENT

(71) Applicant: MAPLE FLEET SERVICES, LIMITED, Stockport, Cheshire (GB)

(72) Inventor: Alan James Maple, Cheadle (GB)

(73) Assignee: MAPLE FLEET SERVICES LIMITED (GB)

( * ) Notice: Subject to any disclaimer, the term of this patent is extended or adjusted under 35 U.S.C. 154(b) by 1201 days.

(21) Appl. No.: 14/802,010

(22) Filed: Jul. 17, 2015

(65) Prior Publication Data

US 2016/0024820 A1 Jan. 28, 2016

(30) Foreign Application Priority Data

Jul. 22, 2014 (GB) ..... 1413002.5

(51) Int. Cl.

| | |
|---|---|
| ***E05B 81/18*** | (2014.01) |
| ***E05B 85/24*** | (2014.01) |
| ***E05B 81/14*** | (2014.01) |
| ***E05B 83/02*** | (2014.01) |
| ***E05B 81/72*** | (2014.01) |
| *E05B 47/00* | (2006.01) |

(52) U.S. Cl.

CPC ..... *E05B 81/14* (2013.01); *E05B 81/72* (2013.01); *E05B 83/02* (2013.01); *E05B 85/24* (2013.01); *E05B 2047/0096* (2013.01)

(58) Field of Classification Search

CPC ..... E05B 81/14; E05B 81/72; E05B 83/02; E05B 2047/0096; E05B 85/24

See application file for complete search history.

(56) References Cited

U.S. PATENT DOCUMENTS 4,318,266 A * 3/1982 Taube ..... A01D 34/008 180/167
4,998,758 A * 3/1991 Kowalczyk ..... E05B 47/0607 292/201
5,577,782 A * 11/1996 Johnson ..... E05B 81/06 292/201
6,485,081 B1 * 11/2002 Bingle ..... E05B 83/26 292/DIG. 43

OTHER PUBLICATIONS

Secure Micro Solutions, Ltd.; SMS Smart-Lock Intelligent Auto Lock System (Trackable); securemicrosolutions.com; 1 page (Circa Jun. 2014).

* cited by examiner

*Primary Examiner* — Kristina R Fulton
*Assistant Examiner* — Thomas L Neubauer
(74) *Attorney, Agent, or Firm* — Renner Kenner Greive Bobak Taylor & Weber

(57) ABSTRACT

An electrically-controlled locking arrangement for a lock mechanism of a commercial vehicle load space door includes a housing and a hook member rotatably mounted within the housing for engagement with an external catch member. A handle is coupled to the hook member to effect movement between open and closed positions. A detent is provided either on the hook member itself or on a component coupled to the hook member, a locking dog being arranged for movement between a locked setting where the dog is in engagement with the detent and a free setting where the dog is clear of the detent, to allow operation of the handle to move the hook member to its open position. An electric actuator is mounted within the housing to drive the locking dog to its free setting allowing rotation of the hook member from its closed position to its open position.

14 Claims, 6 Drawing Sheets

ELECTRICALLY CONTROLLED LOCKING ARRANGEMENT

CROSS REFERENCE TO RELATED APPLICATIONS

This application claims the priority of UK Patent Application No. 1413002.6 filed on Jul. 22, 2014 in the name of Maple Fleet Services Limited.

BACKGROUND TO THE INVENTION (a) Field of the Invention

This invention relates to an electrically-controlled locking arrangement for the lock mechanism of a commercial vehicle load space door. Increasingly, such a lock mechanism is configured as a so-called slamlock, described in more detail below.

(b) Description of the Prior Art

A commercial vehicle such as a delivery van or truck having a closed load space provided with at least one access door normally has a lock mechanism arranged to allow locking of the door in a closed position.

A known form of door lock mechanism has a housing which is secured to the vehicle door by way of security bolts which cannot be released externally of the door. A hook member is rotatably mounted within the housing and projects therefrom for engaging an external catch member provided for example on a frame for the door or on a second door leaf in the case of a commercial vehicle access opening closed by a pair of hinged doors. A handle is coupled to the hook member to effect movement thereof between its open and closed positions. The hook member may be spring-biased to the closed position but is profiled such that closing the door automatically moves the hook member to its open position by interaction with the catch member, the spring then moving the hook member back to its closed position when the door is fully shut.

A lock mechanism as just described may be configured to have an automatic locking characteristic—i.e. configured as a so-called slamlock. This is arranged so that if the door is slammed shut, the lock automatically locks the door shut whereafter the door can be opened only by the use of an appropriate key. Such slamlocks are widely used on commercial vehicle hinged or sliding doors as well as on roller shutter doors and have the advantage that they provide security against opportunist theft from a vehicle left with the door closed but not locked.

A known form of commercial vehicle slam-lock mechanism may have a locking dog within the housing and which is movable between a locked setting and a free setting. When the locking dog is in its locked setting, the hook may be moved to its closed position if it is not already in that position, and the dog is then engaged with a detent provided on the hook member or a component coupled thereto such as the handle or a shaft carrying the hook member. When the dog is in its free setting, disengaged from the detent, the handle may be used to move the hook member between its open and closed positions at will. Typically, a mechanical key-operated lock is associated with the dog, such that the dog may be moved to its free position only by use of the key, whereby the handle may be used to move the hook member to its open position to allow opening of the door.

A commercial vehicle lock mechanism as described above, whether configured as a slamlock or not, will hereinafter be referred to as "a lock mechanism of the kind described."

Increasingly, tracking systems for example employing GPS are being used on commercial vehicles such that the whereabouts of a vehicle is known at all times. Enhanced tracking systems may be arranged so that the opening of the load space door may be permitted only when the vehicle is at a pre-defined location, such as at a warehouse or retail outlet, where goods are to be unloaded from the vehicle. To this end, there is a demand for an electrically-controlled locking arrangement for a lock mechanism of the kind described, whereby the lock mechanism may be released to allow the load space door to be opened only when an appropriate control signal is supplied to the lock mechanism.

Many lock mechanisms of the kind described have a housing which has been designed to accommodate the components of the lock mechanism and there is very little free space within that housing for electrical control mechanisms able to lock the handle or the hook member in the closed position. As such, it is known to provide a second housing arranged for mounting on a door adjacent the housing of a lock mechanism of the kind described, the second housing having supported therewithin appropriate electrical control gear and mechanisms coupled to the lock mechanism of the kind described whereby the operation of the lock mechanism may be controlled. In this way, operation of the handle to release the lock mechanism and allow the door to be opened may be inhibited other than when the vehicle is, for example, at a destination pre-loaded into the system.

The fitting of such a second housing for electrical control gear and the coupling of the mechanisms within that second housing to the lock mechanism of the kind described is difficult and time consuming and moreover requires careful setting-up to ensure proper operation. In addition, the linkage between the mechanisms of the two housings may be open to abuse, so inhibiting the effectiveness of the security which otherwise could be achieved.

OBJECT OF THE INVENTION

It is a principal aim of this invention to provide modified form of a lock mechanism of the kind described, whereby the movement of the hook member to its open position by means of the handle can be controlled by components mounted within the housing of the lock mechanism and so without requiring the use of a second housing to be mounted adjacent the housing of the lock mechanism and having components within the second housing coupled to components of the lock mechanism itself.

BRIEF SUMMARY OF THE INVENTION

According to this invention, there is provided an electrically-controlled locking arrangement for a lock mechanism of a commercial vehicle load space door, the lock mechanism including a housing, a hook member rotatably mounted within the housing and projecting from the housing for engaging an external catch member, a handle coupled to the hook member to effect movement thereof between open and closed positions, a detent provided on one of the hook member and a component coupled thereto, a locking dog mounted within the housing for movement between a locked setting where the dog is in engagement with the detent and a free setting where the dog is not engaged with the detent and the handle is operable to move the hook member to its open position, and an electric actuator mounted within the housing and arranged to drive the locking dog to its free setting so allowing rotation of the hook member from its closed position to its open position.

The electric actuator must be arranged, when activated, to move the locking dog to its free setting from its locked setting, or to maintain the dog in its free setting if already there.

BRIEF DESCRIPTION OF THE SEVERAL VIEWS OF THE DRAWINGS

The drawings show one specific embodiment of an electrically-controlled locking arrangement for a commercial vehicle load space door, the locking arrangement being constructed in accordance with this invention. This embodiment is given by way of example of this invention. In the drawings.

DETAILED DESCRIPTION OF THE INVENTION

Figure 1:
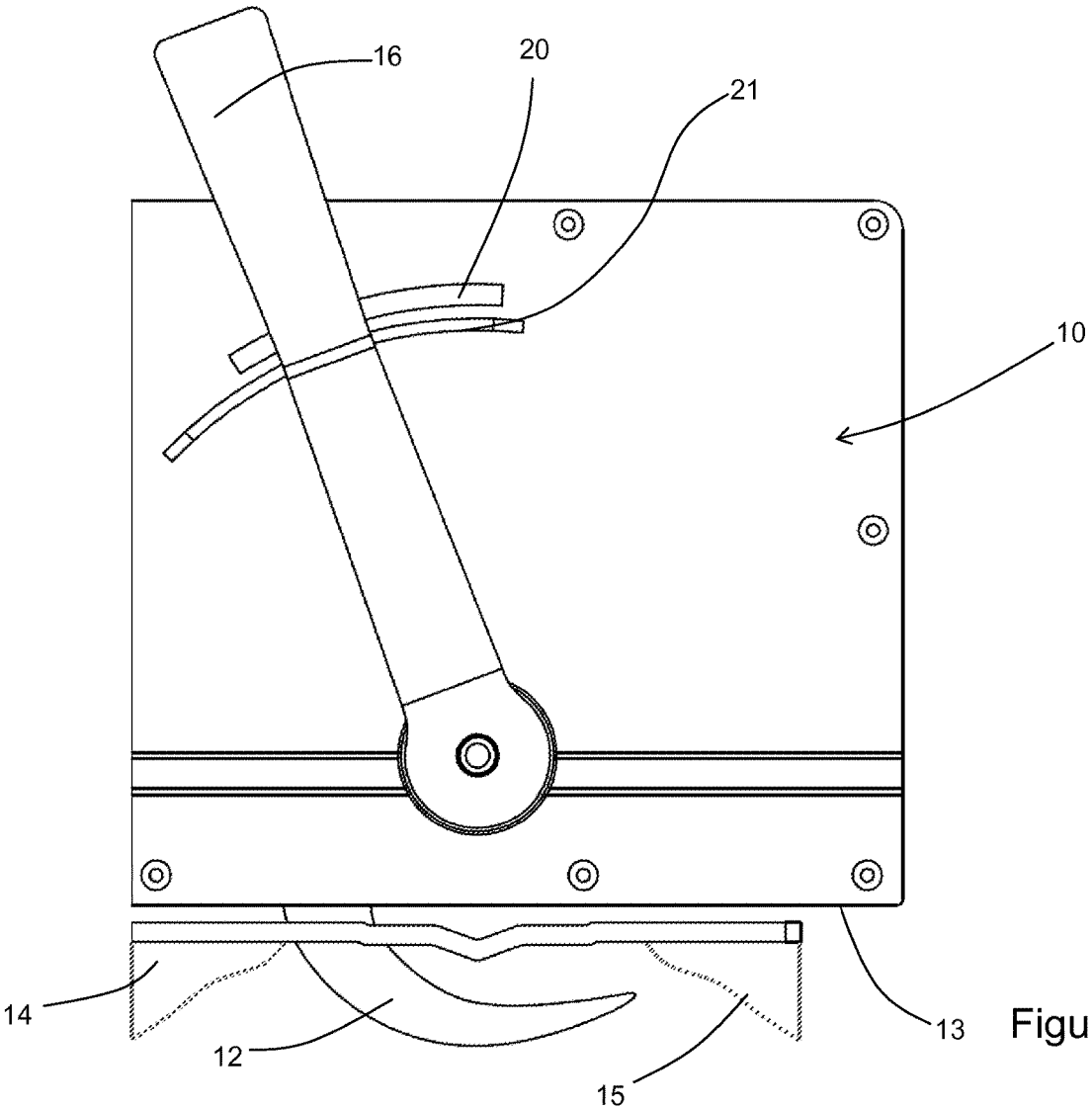
FIG. 1 is a front (external) view of the locking arrangement and catch plate.

It will be appreciated that the electric actuator is a crucial component of this invention in that it controls the operation of the locking dog, either to move the locking dog from its locked setting to its free setting, or to maintain the locking dog in its free setting if already in that setting.

The actuator could comprise a solenoid with an armature connected to the dog and which moves linearly to effect movement of the dog, a disadvantage of a solenoid is that current must be maintained in the solenoid coil in order to keep the armature at one end position. In order to address this problem, it is highly preferred that a relatively small electric motor is employed to drive a cam which is engageable with the locking dog, such that driving the motor in the appropriate sense will turn the cam to move the locking dog to its free setting. When moved as required, current may be removed from the motor and there will be no further current drain until the cam is to be turned once more.

A particular kind of electric motor which has been found suitable for use with a locking mechanism of the kind described is a small servomotor of a size suitable for mounting within the housing of the lock mechanism. Such a servomotor suitable for use with the lock mechanism may be the same as, or similar to, a proportional servomotor of a radio-control system; such a servomotor has a miniature electric motor driving an output shaft through a reduction gear train. Servomotors of this kind are widely used with model aircraft, helicopters, vehicles and boats, as well as with quadricopters as may be used for aerial surveillance, drones and the like. A typical servomotor of this kind has a compact housing and is capable of exerting relatively high torque whilst being accurately controllable by an analogue or digital signal for movement between pre-defined limits. It is therefore highly preferred that a digital proportional servomotor of this kind is employed within the housing of the lock mechanism, to control the operation of the cam, and so of the locking dog.

In a case such as that described immediately above, the servomotor is advantageously provided with a driving crank, arm or disc which is coupled to the cam by a push-rod, to effect rotation of the cam. Such a push-rod may be provided with ball-joints in a manner known in the art, with the ball of the joint at one end of the push-rod being mounted on the servomotor arm or disc and the ball of the joint at the other end of the push-rod being secured to a radial face of the cam whereby operation of the servomotor effects rotation of the cam.

In one known lock mechanism of the kind described, the locking dog is mounted within the housing for rotation between its locked and free settings. The electric actuator may act directly on the locking dog to drive it to its free setting, when the actuator is activated. In a preferred embodiment, the locking dog is in the form of a first order lever having arms projecting to each side of a pivot, the free end of one of the arms being profiled for engagement in the detent and the electric actuator is supported within the housing to act on the other arm of the locking dog. In the case of the actuator being a servomotor coupled to a cam, the cam may act on said other arm of the dog in order to turn the dog to its free setting, and maintain the dog in that setting until the cam is turned once more back to a position where the dog may be moved to its locked setting. Preferably, the dog is spring-urged to its locked setting, such that operation of the actuator in one sense will drive the dog to its free setting and maintain the dog in that setting until the actuator is operated in the other sense, so allowing the dog to return to its locked setting, under the action of the spring.

The locking arrangement of this invention may be provided with a control unit which supplies drive current to the electric actuator when the door is to be opened, thereby to move the locking dog to its free setting and allow operation of the handle for turning the hook member to its open position and allow opening of the door. Such a control unit may include an input device operable by a person wishing to gain access to the load space. Such an input device may comprise a simple mechanical key lock but preferably comprises a wireless control pad such as a key fob having buttons for opening and locking the door. In addition, the control unit may include a display for user information, such as to show the current state of the lock mechanism. Moreover, the control unit may include a GPS tracking system as described above, and allow the input of data such as those locations where unlocking of the door is permitted.

It is preferred for there to be at least one switch associated with the locking dog and arranged to control the operation of the electric actuator. For example, it could happen that the locking dog has been fully engaged with the detent and is jammed in that position by an excessive force applied to the handle; in that case, an excessively large force may be required to drive the locking dog to its free setting out of engagement with the detent, and the electric actuator may be incapable of driving the dog with a sufficient force to achieve that. A microswitch having a trigger may therefore be provided adjacent the locking dog, the trigger being operated by the locking dog when the locking dog is fully engaged with the detent so as then directly or indirectly to inhibit operation of the electric actuator until pressure on the dog is relieved by operation of the handle. Thus, the microswitch may be connected to the control unit which is arranged to respond to the state of the microswitch and also to give an indication to a vehicle driver that pressure on the handle must be eased before the lock mechanism may be released.

Though the first microswitch may be arranged to change its state only when the locking dog has been fully engaged (and possibly jammed) with the detent, a second microswitch may be provided to supply an output to the control unit to indicate that the door has been closed and locked, even though the locking dog may not be fully engaged with the detent. The second microswitch may also be operated by the locking dog but may have its state changed by the locking dog before the first microswitch reacts to full engagement of the locking dog with the detent.

It will be appreciated that a particular advantage of the electrically-controlled locking arrangement of this invention is that it may be retro-fitted to an existing lock mechanism of the kind described for a commercial vehicle load space door. The use of a relatively small electric actuator such as a small servomotor and rotatable cam allows those components to be fitted within the housing of the lock assembly and then all that is required is the provision of a control unit at a suitable location on the vehicle, together with wiring for the control unit and between the control unit and the electric actuator.

DETAILED DESCRIPTION OF THE DRAWINGS

Figure 2:
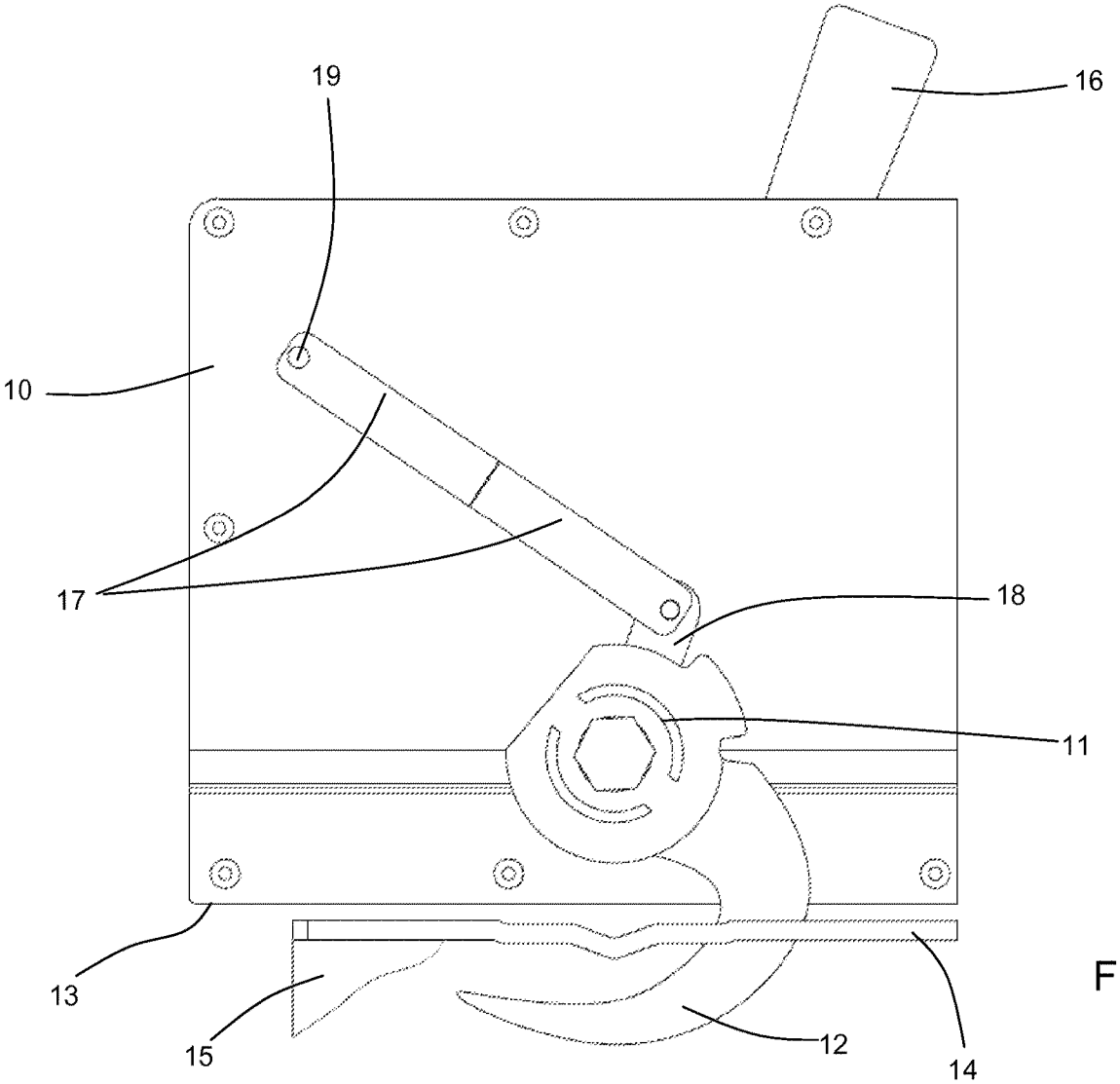
FIG. 2 is a rear view of the locking arrangement of FIG. 1.

This embodiment of electrically-controlled locking arrangement shown in the drawings is configured as a lock for a commercial vehicle load space door such as a roller shutter. In the accompanying drawings, the door is not shown but FIGS. 1 and 2 show a housing 10 configured to be secured to a margin of the door—a lower member of the door in the case of a roller shutter door or the housing could be secured to a vertical edge member in the case of a sliding or hinged door such as may be used with a delivery van. A shaft 11 is rotatably mounted in the housing 10 and carries a hook member 12 which projects from the lower edge 13 of the housing, for cooperation with a catch plate 14 provided as a part of a frame member 15 for the door. The hook member 12 is provided with an over-centre spring assembly such that the hook member will be urged either to its closed position as shown in FIGS. 1 and 2 or to its open position (not shown), on being moved to either of those positions by a handle 16 mounted on the shaft externally of the housing.

The over-centre spring assembly includes telescoping tubes 17 pivoted at one end to a lug 18 connected to the shaft 11 and so indirectly to the hook member 12 and at the other end to a peg 19 provided on the housing 10. A compression spring is located within the tubes and so serves to bias the hook member to its open or closed position depending upon the angular position of the shaft 11. Externally of the housing, there is a curved lock plate 20 secured to the housing and a bracket 21 welded to the handle 16. Holes (not shown) are provided in the lock plate 20 and bracket 21, which holes come into register when the handle is in the locked position for the hook member, such that a padlock or similar lock device may be passed through the registering holes and so secure the lock mechanism in its locked setting.

Figure 3:
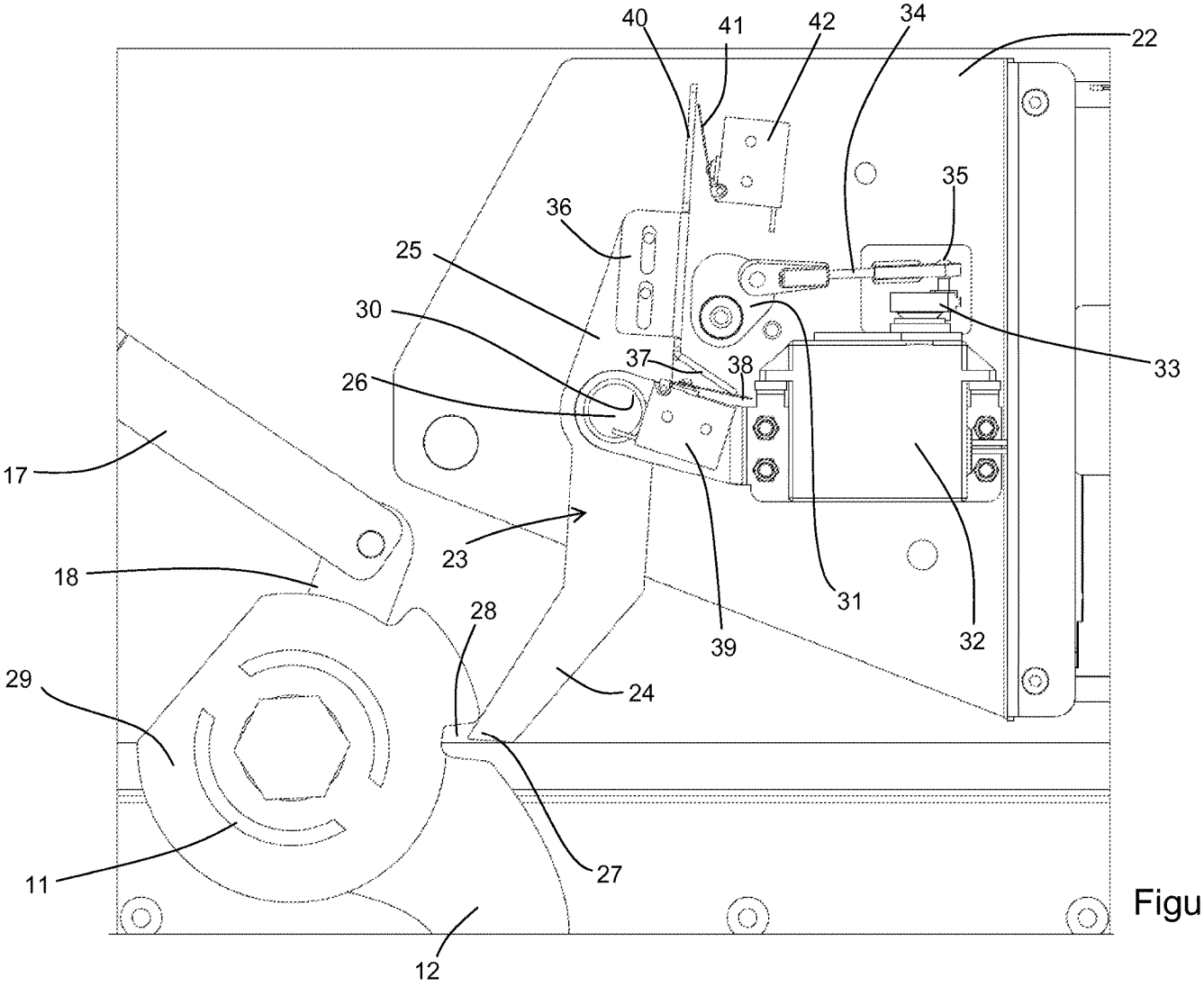
FIG. 3 shows the components within the housing of the locking arrangement of FIGS. 1 and 2, with the hook member locked against opening.
Figure 4:
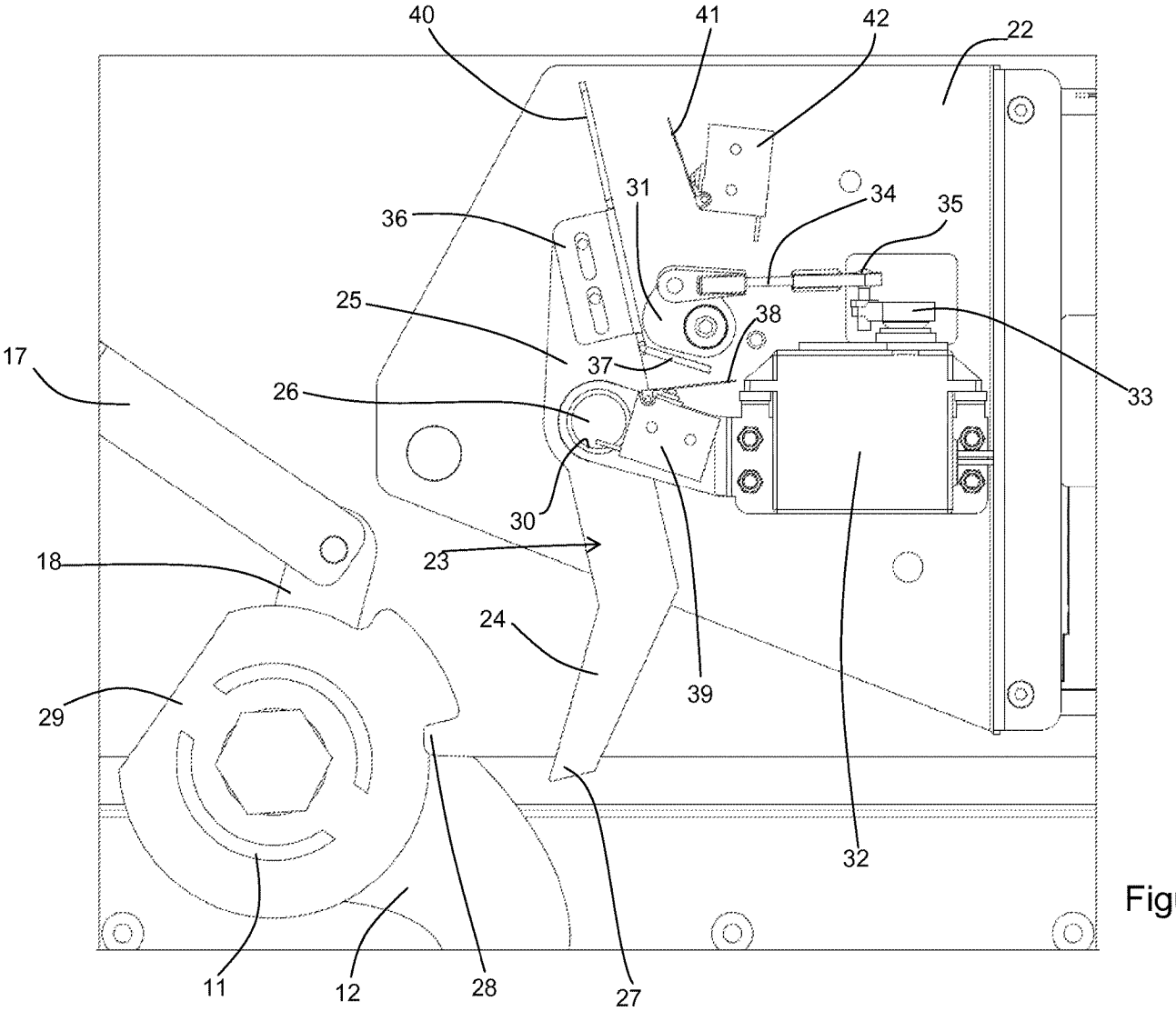
FIG. 4 is similar to FIG. 3 but shows the hook member unlocked.

FIGS. 3 and 4 show the components mounted within the housing 10, to give the required functionality for the lock. A mounting plate 22 is disposed within the housing and rotatably supports a locking dog 23 in the form of a first order lever having first and second arms 24 and 25 projecting from opposite sides of a pivot 26 for the lever. The free end 27 of the first arm 24 is profiled for interaction with a detent 28 formed in a hub 29 of the hook member 12 such that when the dog is in a locked setting (FIG. 3) the free end 27 is received in the detent 28 and the dog will prevent rotation of the hook member in a counter-clockwise sense (FIGS. 3 and 4). When the dog is in a free setting (FIG. 4) the free end 27 is disengaged from the detent and so allows rotation of the hook member in a counter-clockwise sense (FIGS. 3 and 4). A torsion spring 30 is disposed around the pivotal axis of the dog 23, to bias the dog to its locked setting shown in FIG. 3 but a simple tension spring could be arranged between one of the arms of the dog and the mounting plate, to achieve the same functionality.

A cam 31 is rotatably mounted on the plate 22 about an axis parallel to that of the locking dog 23 and hook member 12, for cooperation with the second arm 25 of the dog 23. The first angular position of the cam 31 is shown in FIG. 3 and in this position the dog 23 may move under the action of spring 30 to engage the free end 27 of the first arm 24 in the detent 28 of the hook member, so preventing rotation of the hook member in a counter-clockwise sense by the handle 16. The second angular position of the cam 31 is shown in FIG. 4; here, the cam has been rotated through approximately 90° in a counter-clockwise sense (FIGS. 3 and 4), so driving the dog 23 also in a counter-clockwise sense against the action of spring 30, to move the free end 27 of the first arm 24 out of the detent 28 and clear of the hook member 12 (FIG. 4). When in this setting, as mentioned above, the handle 16 may be swung through an arc to release the hook member from the catch plate 14 and allow the door to be opened.

Figure 6:
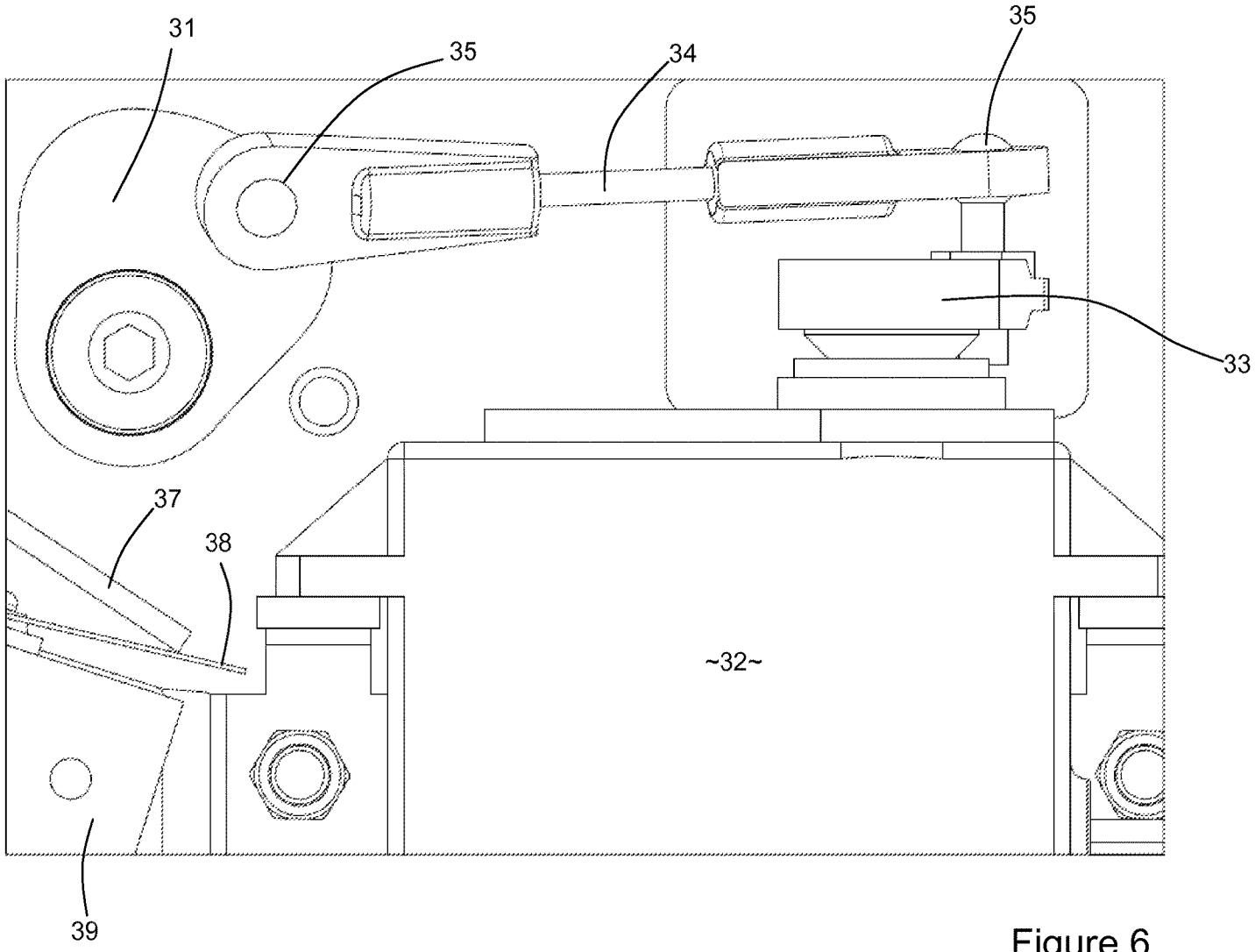
FIG. 6 is a detail view on an enlarged scale of part of the servomotor and cam, used in the locking arrangement of this embodiment.

A digital proportional-control servomotor 32 is supported on the mounting plate 22 and has an output shaft provided with a crank arm 33. Internally, the servomotor has a miniature electric motor driving the output shaft through a reduction gear train and also has control electronics for driving the servomotor between end limits defined by an electrical signal applied to the servomotor. A push-rod 34 links the crank arm 33 and the cam 31, ball joints 35 (FIG. 6) being provided at the two ends of the push-rod. The angular disposition of the crank arm 33 is such that turning movement of the output shaft of the servomotor through approximately 90° serves to drive the cam 31 between its first and second positions—that is, the positions of FIGS. 3 and 4.

A control plate 36 is adjustably secured to the second arm 25 of the locking dog 23 by means of screws passing through slots in the control plate, whereby the position of the control plate may be adjusted in a generally radial direction. The control plate includes a leg 37 projecting from the second arm 25 in the plane of the locking dog, for cooperation with the operating trigger 38 of a first microswitch 39 mounted closely adjacent the pivot 26 of the locking dog. An radial extension 40 of the control plate cooperates with the operating trigger 41 of a second microswitch 42, mounted remotely of the cam and servomotor. The operation of those microswitches will be explained below.

The locking arrangement includes an external control unit (not shown) for operation of the servomotor. That control unit may supply power to the servomotor to cause the servomotor to rotate the crank arm 33 between pre-defined limits, in a manner well known and understood in the radio control art which will not therefore be described here. The control unit may include a wireless receiver responsive to a wireless signal generated by a key fob in much the same way as is employed with motor vehicle remote locking systems, which also are well known and understood in the art. Further, the control unit may include a GPS receiver and a transmitter for transmitting tracking information via a satellite back to a base station in order that the whereabouts of the vehicle may be determined remotely. Such tracking information may be used to inhibit operation of the servomotor, and so of unlocking of the locking arrangement, until the vehicle is at a pre-set location.

Taking the starting position to be as shown in FIG. 3, with the hook member 12 engaged with the catch plate 14 (FIG. 1) and the free end 27 of the locking dog received in the detent 28, the door is locked closed. When the door is to be unlocked and opened, power is supplied to the servomotor in order to cause the cam to rotate from the first position shown in FIG. 3 to the second position shown in FIG. 4. This turns the cam so as to drive the dog 23 against the action of spring 30 to release the free end 27 of the first arm 24 from the detent 28 of the hook member 12. The dog 23 will remain in that free setting until the servomotor is powered once more to allow the dog to return to its locked setting under the action of spring 30. With the dog in its free setting, the door may be opened and closed at will, the handle being freely movable between the locked and open positions.

Figure 5:
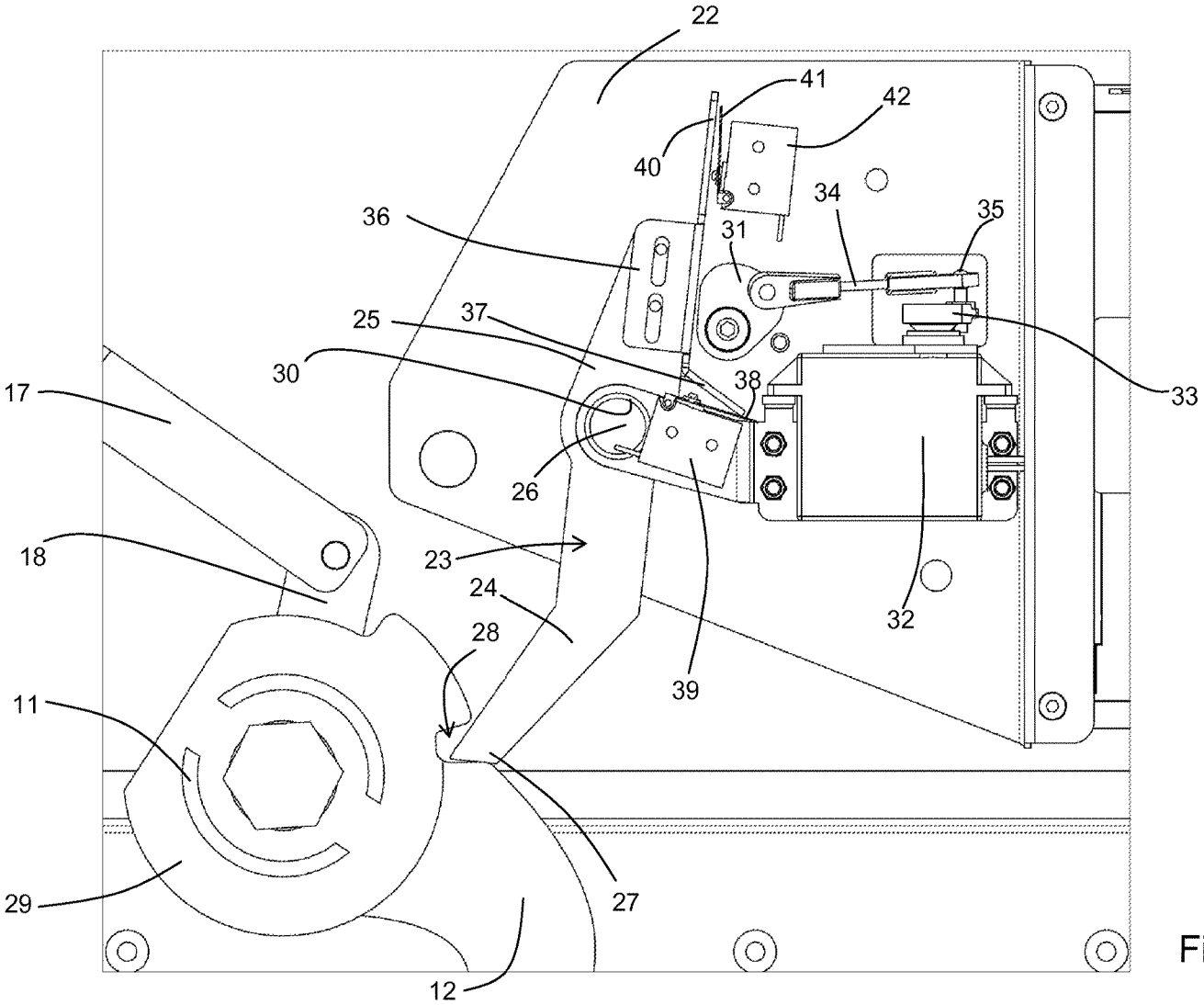
FIG. 5 shows the locking dog fully engaged with the detent provided on the hook member and jammed therein.

The above operation is possible only if the free end 27 of the first arm 24 of the dog is lightly received in the detent 28. If the free end of the dog is fully engaged with the detent as shown in FIG. 5, it may be jammed in that detent and the servomotor may be unable to exert sufficient force to move the dog to its free setting. This is in effect an abnormal condition for the lock mechanism and could occur if for example there is a small obstruction on the frame member 15 preventing full closing of the door, such that the driver pushes the handle relatively firmly to its locked position, so jamming the dog in its locked setting.

In order to inhibit the supply of power to the servomotor in that abnormal condition shown in FIG. 5, the control unit reacts to the state of the first microswitch 39 and inhibits the supply of power to the servomotor if the first microswitch is fully closed by the leg 37 of the control plate 36. Should this occur, the control unit will present the operator with a message, informing the operator to swing the handle a little in the unlocking sense before depressing the appropriate "unlock" button on the key fob once more to cause the cam to be driven by the servomotor and move the dog to its free setting. In this way, placing an excess load on the servomotor, possibly leading to the stalling thereof, can be prevented.

The control unit may generate a seal code when the door has been closed and locked shut, for transmission back to a tracking station. Such a code may be generated when the door has been locked shut (FIG. 3), but not necessarily with the free end 27 of the first arm 24 fully engaged with the detent 28 of the hook member 12 (FIG. 5). The second microswitch 42 is provided for the purpose of notifying the control unit that the door has been closed, as soon as the locking dog 23 has been received in the detent (FIG. 3) but not necessarily fully engaged as shown in FIG. 5. The second microswitch thus detects when the dog is in its locked setting which will prevent the hook from turning, but has a range of movement that also allows the first microswitch 39 to be in either an open or closed position.

I claim:

1. An electrically-controlled locking arrangement for a lock mechanism of a commercial vehicle load space door, the lock mechanism including a housing, a hook member rotatably mounted within the housing and projecting from the housing for engaging an external catch member, a handle coupled to the hook member to effect movement thereof between open and closed positions, a detent provided on one of the hook member and a hub coupled thereto, a locking dog mounted within the housing for movement between a locked setting where the dog is in engagement with the detent and a free setting where the dog is not engaged with the detent and the handle is operable to move the hook member to its open position, and an electric actuator mounted within the housing and arranged to drive the locking dog to its free setting so allowing rotation of the hook member from its closed position to its open position, wherein the locking dog is mounted within the housing for rotation between said locked and free settings, and wherein the locking dog is in the form of a first order lever having first and second arms to each side of a pivot for the first order lever, a free end of the first arm being engageable in the detent thereby to block movement of the handle and hook member from said closed position and the electric actuator is supported adjacent the second arm, for driving the locking dog to said free setting.

2. An electrically-controlled locking arrangement as claimed in claim 1, wherein the locking dog is spring-biased to said locked setting.

3. An electrically-controlled locking arrangement as claimed in claim 1, wherein the locking dog is spring biased to said locked setting and the electric actuator is arranged to maintain the locking dog in said free setting irrespective of movement of the hook member between its open and closed positions, until the electric actuator is operated to allow the locking dog to move to said locked setting under the action of the spring-bias.

4. An electrically-controlled locking arrangement as claimed in claim 1, wherein the electric actuator comprises a solenoid having an armature arranged to drive the locking dog to said free setting.

5. An electrically-controlled locking arrangement as claimed in claim 1, wherein there is at least one switch associated with the locking dog and arranged to inhibit the supply of driving current to the electric actuator when the locking dog is fully engaged with the detent.

6. An electrically-controlled locking arrangement as claimed in claim 1 and including a switch associated with the locking dog, said switch being operated whenever the locking dog is at least partially engaged with the detent.

7. An electrically-controlled locking arrangement as claimed in claim 1, wherein there is a first switch associated with the locking dog, said first switch being operated whenever the locking dog is at least partially engaged with the detent, and there is also a second switch associated with the locking dog and arranged to inhibit supply of driving current to the electric actuator when the locking dog is fully engaged with the detent.

8. An electrically-controlled locking arrangement as claimed in claim 1 in combination with a control unit for the locking arrangement, said control unit supplying driving current to the electric actuator.

9. An electrically-controlled locking arrangement as claimed in claim 8 and in which there is provided at least one switch associated with the locking dog, said switch being operated whenever the locking dog is at least partially engaged with the detent, wherein the switch is connected to the control unit and the supply of driving current to the electric actuator depends upon the condition of said switch.

10. An electrically-controlled locking arrangement as claimed in claim 8 and in which there is provided first and second switches associated with the locking dog, said first switch being operated whenever the locking dog is at least partially engaged with the detent, wherein the switch is connected to the control unit and the supply of driving current to the electric actuator depends upon the condition of said switch, and said second switch is arranged to inhibit the supply of driving current to the electric actuator when the locking dog is fully engaged with the detent.

11. An electrically-controlled locking arrangement as claimed in claim 8, wherein the control unit includes a GPS tracking system and the supply of driving current to the electric actuator is conditional upon the physical location of the tracking system.

12. An electrically-controlled locking arrangement for a lock mechanism of a commercial vehicle load space door, the lock mechanism including a housing, a hook member rotatably mounted within the housing and projecting from the housing for engaging an external catch member, a handle coupled to the hook member to effect movement thereof between open and closed positions, a detent provided on one of the hook member and a hub coupled thereto, a locking dog mounted within the housing for movement between a locked setting where the dog is in engagement with the detent and a free setting where the dog is not engaged with the detent and the handle is operable to move the hook member to its open position, and an electric actuator mounted within the housing and arranged to drive the locking dog to its free setting so allowing rotation of the hook member from its closed position to its open position, wherein the electric actuator comprises a servomotor drivingly coupled to a cam arranged to drive the locking dog to its free setting, wherein the servomotor has an output shaft provided with a crank arm coupled to the cam by a push-rod to effect rotation of the cam.

13. An electrically-controlled locking arrangement as claimed in claim 12, wherein the servomotor comprises a proportional radio-control system servomotor.

14. An electrically-controlled locking arrangement as claimed in claim 12, wherein the push-rod has two ends each provided with a ball joint, one ball being mounted on the crank arm and the other ball being mounted on a radial side face of the cam.

* * * * *